United States Patent [19]

Bachli

[11] 4,000,841

[45] Jan. 4, 1977

[54] MULTI-COMPARTMENT, MULTI-LEVEL STACKING CARRIER, PARTICULARLY FOR SMALL PARTS, TOOLS, AND THE LIKE

[76] Inventor: Emil Bächli, Hauptstrasse 156, CH 5304 Endingen, AG, Switzerland

[22] Filed: Apr. 29, 1975

[21] Appl. No.: 572,842

[30] Foreign Application Priority Data

Apr. 29, 1974 Switzerland ..... 6097/74
Apr. 24, 1975 Switzerland ..... 5381/75

[52] U.S. Cl. ..... 224/48 R; 211/190; 206/821; 108/149

[51] Int. Cl.[2] ..... A47G 23/06

[58] Field of Search ..... 224/48 F, 48 R; 206/821, 501, 503, 509; 211/176, 177, 178, 126; 108/149, 143; 248/128, 129, 150, 186

[56] References Cited

UNITED STATES PATENTS

| | | | |
|---|---|---|---|
| 886,324 | 4/1908 | Norris | 206/821 |
| 2,187,355 | 1/1940 | MacManus | 206/821 |
| 2,556,105 | 6/1951 | Rhett | 108/149 |
| 2,826,333 | 3/1958 | Rodemich | 206/821 |
| 3,392,848 | 7/1968 | McConnell et al. | 211/176 |
| 3,799,072 | 3/1974 | Slaboden | 108/149 |

*Primary Examiner*—Robert J. Spar
*Assistant Examiner*—Kenneth Noland
*Attorney, Agent, or Firm*—Flynn & Frishauf

[57] ABSTRACT

A plurality of trays of substantially similar outline are stacked above each other. At least two elongated guide rods or posts are located at opposite sides of the carrier trays and extend perpendicularly through the trays, the guide posts being formed with folding joints, each, to permit folding them over when the trays are stacked tightly against each other, to serve as a carrying handle, while, upon erection, permit the trays to be slid vertically, with clearance, for access to the contents of the trays; the top tray is formed with a lock, engaging the upright posts to lock the top tray in position, when the posts are erected, the lock preferably including a spring-loaded, notched finger engaging a cross element or cross bar on the respective posts, which cross bar can hook into a locking eye on the topmost tray to lock the handles in position when folded, so that they can serve as a carrying handle for the entire tray assembly.

11 Claims, 5 Drawing Figures

MULTI-COMPARTMENT, MULTI-LEVEL STACKING CARRIER, PARTICULARLY FOR SMALL PARTS, TOOLS, AND THE LIKE

The present invention relates to a multi-level, multi-compartment stacking tray or carrier and more particularly to such a carrier for hand tools, parts and the like, which is especially adapted to be carried around, for example when making service calls on appliances, for use in planted set-ups, garages, and in general where an easily made, inherently lightweight, portable multi-compartment carrier is needed.

Various types of tools, supplies, spare parts and the like are frequently carried as a unit where needed. It has been proposed (see, for example, Swiss Patent 322,378) to provide a mobile carrier for tools and supplies in which a plurality of vertical posts are mounted on a rolling, wheeled support base, the posts carrying support elements such as cross pins, cotter pins, clamps, or the like, which support superimposed trays in spaced, stacked vertical alignment. The posts may be formed with notches or grooves and the top cover can be locked in position on the posts by engaging a catch, or the like, in a respective groove or notch.

Mobile carts to carry tools and supplies and the like have also been described, particularly for use in garages, machine shops and the like, and in which compartments to receive tools and supplies can be laterally flipped outwardly, in fan-shaped arrangement (see "Schweizer Maschinenmarkt" Vol. 71, Issue 2, 1971 — Swiss Machine Market).

The arrangements previously described have the disadvantage that they are comparatively heavy and do not lend themselves to ready portability, being essentially designed to be mounted on a wheeled dolly, or platform support. They are not handy to be carried around, and are not designed for use by service personnel which may be required to carry out repairs in various customers' homes, or at various locations.

Tool chests and tool carriers, as well as supply chests made of metal require accurate manufacture to provide ease of use and ready opening of the compartment, as well as subsequent locking thereof. Sliding of compartments or drawers must be uniform and smooth. If plastic or other non-metal materials are used, accurate guiding of trays or drawer elements, as well as of the cover is important since, otherwise, upon loading these parts might tip when being opened, or slid outwardly from their support position. Guide or slide surfaces must be kept meticuously clean; penetration by foreign substances, dust, dirt, and particularly metal chips or the like, will tend to cause drawers and other sliding elements to jam. Frequently such compartments and tools chests function well only when comparatively new due to abuse; accurate manufacture of support posts, guide ways and the like, as well as guides in intermediate levels for trays and cleanliness in use — which is not always maintained — are required for efficient operability.

It is an object of the present invention to provide a readily portable stacking carrier, in the nature of a tool and supply chest which is so constructed that the disadvantages of the prior art are avoided, and which is inherently lightweight as well as manually portable. The construction, further, should be simple, not weigh more than the well-known side-opening tool chests or carriers and which has a handle to permit ready portability. The construction should be further so carried out that it is easily erected and collapsed, contains a locking arrangement which is simple and can be readily manufactured, and which lends itself to use with existing tool chests or trays, while being sturdy and rigid when erected.

Subject matter of the present invention: Briefly, a plurality of trays of substantially similar outline are stacked above each other. At least two elongated guide rods or posts are provided, extending vertically from the bottom tray. The guide rods or posts have articulated joints which, when erected, guide the trays for vertically spaced position and, when folded, serve as a carrying handle. The trays themselves are guided on the guide posts, preferably by means of prismatic guide elements engaging the guide posts (which, preferably, are circular in cross-section). The upper guide tray is provided with a spring-loaded locking lever, preferably having a notch, the notch engaging in a cross pin adjacent the upper end of the posts. To release the trays and stack them tightly against each other, the lever is manually operated against the spring pressure.

In accordance with a feature of the invention, the posts can be folded inwardly over the top tray, so that the posts fit above each other to lock against each other and form a sturdy carrying handle when the trays are fitted against each other in vertically stacked alignment.

The locking arrangement, in accordance with a preferred form of the invention, can engage the cross pins of the posts as the top tray is pulled upwardly. The various intermediate trays and their covers (if any) are reliably guided on the upright posts; upon loading the various trays, the guide surfaces fitted on the trays and engaging the posts are pressed against the posts; upon increasing loading of the trays, the strength and stability of the assembly is enhanced. When the entire assembly is erected and loaded, the stress relationships will be essentially equivalent to that of a frame construction, which is stable with respect to lateral deflection, as well as against torsion.

The invention will be described by way of example with reference to the accompanying drawings, wherein.

Figure 1:
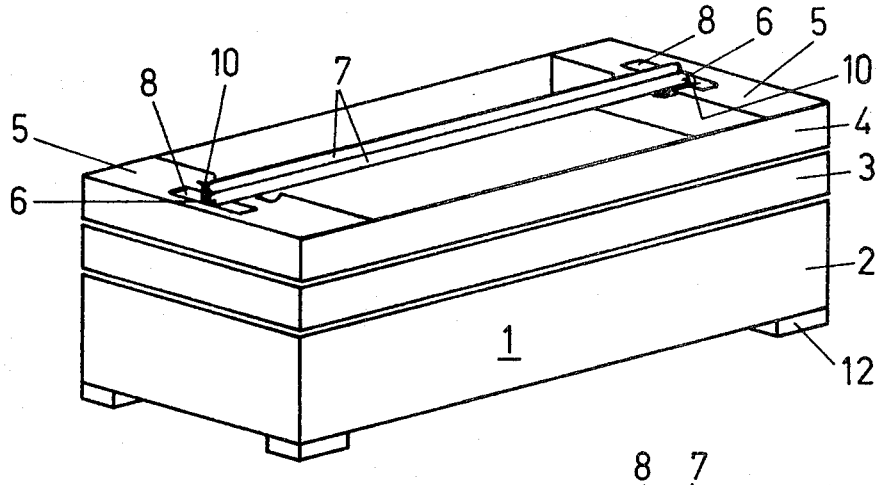
FIG. 1 is a perspective view of an assembled carrier, in collapsed, closed condition, ready to be carried about.
Figure 2:
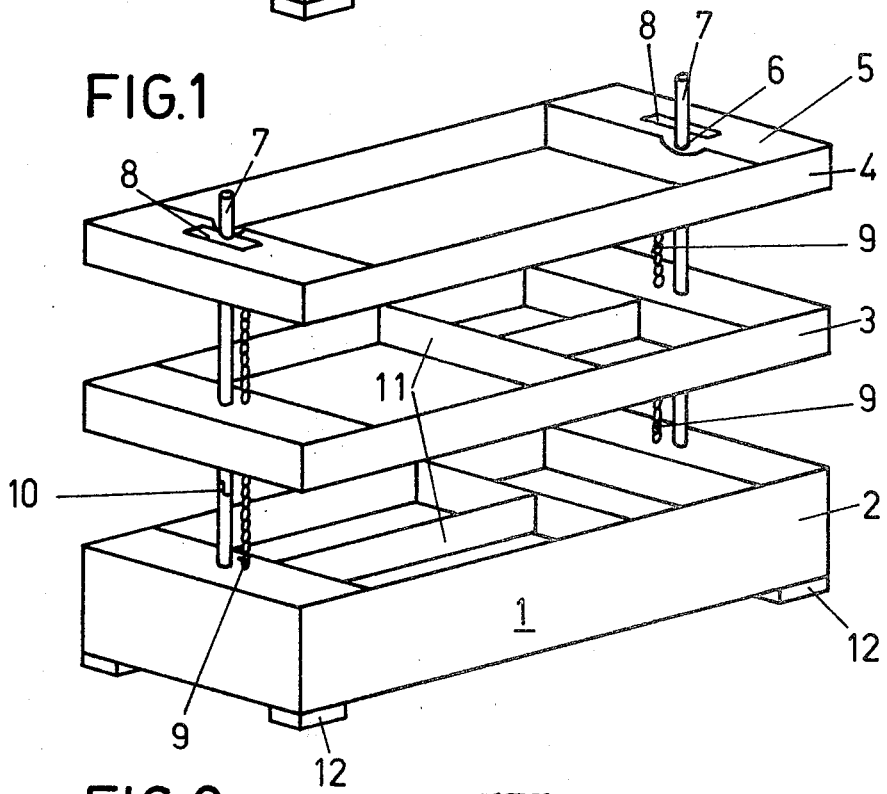
FIG. 2 is a view similar to FIG. 1 with the trays separated from each other, for use in removing tools or service parts from the trays of the carrier.

The carrier 1 (FIGS. 1, 2) includes three trays 2, 3, 4, which may be of different depth; tray 4 simultaneously forms the top cover for trays 2 and 3; an additional top cover may also be provided, and the number of trays can be suitably selected. If the top cover is flat, it may serve as a work surface, and simultaneously permit locking away of all the tools and supplies within the tray compartments. The trays are rectangular and the opposite shorter sides are formed with reinforcements 5. The reinforcements 5 are formed with openings 6 therein through which upright guide posts 7 extend. The guide posts 7 have joints 10 intermediate their length. The upper tray 4 (and the term "tray" will here also denote a flat top cover, if such is used) includes a locking arrangement 8 (see also FIGS. 4 and 5) which locks the uppermost tray in position as shown in FIG. 2. The locking arrangement may have various forms; for example it can be arranged to laterally engage in a notch formed adjacent the upper end of the respective post 7 or, as will be explained in connection with FIGS. 4 and 5, can engage a cross pin or bolt 30 (FIG. 4) by means of a locking lever 26.

Figure 3:
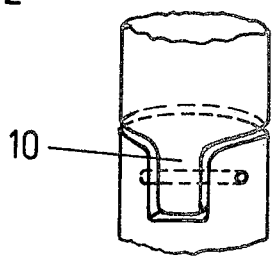
FIG. 3 is a fragmentary greatly enlarged perspective view of a joint for a post.

FIG. 2 illustrates the carrier with the trays separated, to permit ready access to the interior compartments thereof. The joints 10 at the two posts at opposite sides are offset from each other by the thickness of the posts 7 so that, when folded, the posts will fold freely and fit in vertical alignment (see FIG. 1). The joints 10 are so constructed that the posts can fold only in one direction, but lock vertically against folding in the other direction, as illustrated in FIG. 3, in which the right-side post (with respect to FIGS. 1 and 2) is shown, permitting folding forward, to the left, but not in the other direction, similar to a knee joint. Upon erection of the carrier, the posts 7 are straightened and the top tray 4 is lifted upwardly until the lock 8 engages with the locking notch, or cross pin in post 7. The various trays are maintained in vertical spaced position by means of a tension element 9, such as a chain, a vertical holding rope with enlargements or knots beneath the trays, or the like. Ropes, particularly of plastic material with longitudinally adjustable clamps are lightweight and provide for versatile individual height adjustment, as well as for easy replacement. To collapse the assembly of FIG. 2 to the position of FIG. 1, the lock 8 is released, permitting the trays to slide against each other; the knee joints 10 are then folded over, so that the posts will fold inwardly to the position shown in FIG. 1.

Trays 2, 3, 4 are sub-divided into compartments which are preferably arranged to be individually adjustable, for example by forming racks or corrugations at the inner walls of the trays, in which dividers can engage. Such adjustable arrangements are not shown in the drawings and well known.

The lower tray 2 is preferably formed with leg extensions 12. The legs 12 may include holders for casters, wheels or the like, or may be formed, directly, as wheels, to permit easy movement of the carrier, particularly when erected.

Figure 4:
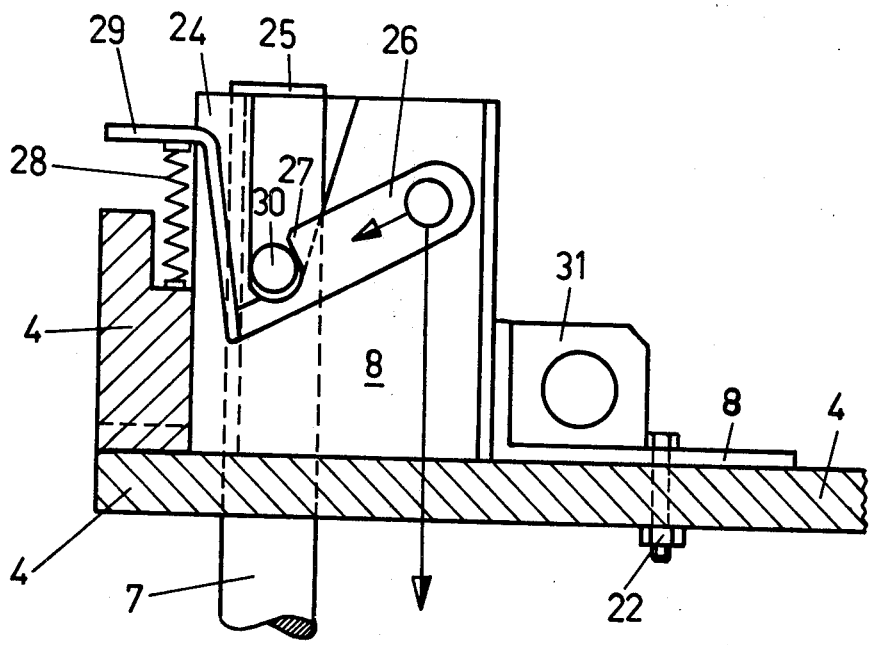
FIG. 4 is a longitudinal sectional view through one form of a locking arrangement.
Figure 5:
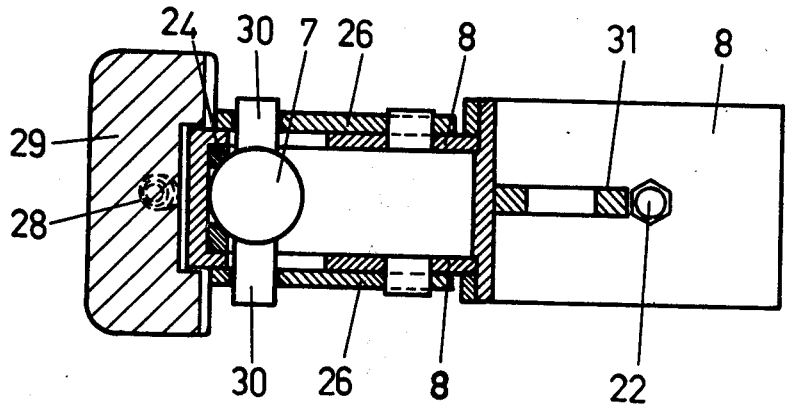
FIG. 5 is a top view, partly in section, of the locking arrangement of FIG. 4.

The lock 8 (FIGS. 4, 5) is secured to the top tray, or cover 4 in known manner, for example by screws 22. The posts 7 are circular in cross section, and to guide the tray and the lock, the opening through the tray has prismatic guide elements 24 located therein, extending vertically and engaging partially the circumference of the post 7. Post 7 may be made of metal or metal tubing; the guide elements themselves may be made of plastic, or other easily slidable material, or coated with a slippery material. The lock 8 further includes a pivoted locking lever 26 which is formed with a notch 27. The lever 26, which is formed as a forked lever extending from both sides of a central spur of the lock 8 (see FIG. 5) is extended to the outside of the tray to terminate in a manually operable pushbutton 29. A spring 28 biasses the lever 26 in an upward direction (FIG. 4). The post 7 is formed with a cross pin, or cross holding bolt 30 which extends at right angle with respect to the longitudinal sides of the lock 8. The notch 27 of the locking lever 26 is arranged to engage in the cross pin 30. A locking eye 31 is located at the inner side of the lock 8 in which the pin 30 of the other post can engage when the posts are folded over, to form a carrying handle. The vertical spacing of the eye 31 from the top of the tray 4 of the lock for the other side would be higher than the one shown in FIG. 4, offset by the thickness of post 7. The spacing of the eye 31 from the top surface of the top tray or cover 4 may be suitably selected to permit ready grasping of the folded posts 7.

The posts 7 are suitably secured to the bottom of the lower tray 2, for example by washers and a counter nut.

Operation, erection and collapse, and use: In closed condition (FIG. 1), that is, when the carrier 1 is closed and the trays are fitted against each other, the guide posts 7 are collapsed so that they lie above each other, thereby simultaneously forming a carrying handle for the carrier. The location of the joints 10 is so selected that the lock 8, together with the tray 4 to which it is secured, are below the joints 10 when the carrier is collapsed. To erect the carrier, the posts 7 are straightened by folding them upwardly, so that they will stand vertically. The top tray or cover 4 is lifted at both sides simultaneously, so that the attached intermediate tray (or any other trays) are carried along as the tray 4 is lifted. When the tray 4 has reached its topmost position, notch 27 engages in bolts 30, due to the spring-loading thereof, snapping over the bolt. The weight of the top tray or cover 4, together with the weight of the intermediate tray 3 (or such other further trays as may be provided) provides forces acting on the lock 8 which are indicated by the arrows in FIG. 4. As the loading on tray 4, or on any of the suspended trays increases, the stability of the entire assembly will likewise increase since the locking lever 26 tends to cam the post 7 outwardly, to engage with the vertical prismatic guide elements 24. Notch 27, pressing against cross pin 30, so acts on the prismatic guides 24 to increase the stability of position of the top tray upon loading.

To collapse the carrier, the push bar 29 is moved downwardly (FIG. 4) counter the force of spring 28, thus releasing the lever 26 and its notch 27 from the cross pin 30. The cover or tray 4 can slide downwardly on the guide post 7. The prismatic guide 24 ensures uniform, smooth sliding and prevents lateral tipping of the various trays and of the cover. The intermediate tray 3 (or trays) is likewise formed with guide surfaces 24, or with similar guide arrangements.

Various other types of locking arrangements may be used, although the illustrated arrangement provides for particularly good stability upon loading. For example, instead of cross bolts 30, the guide post 7 can be formed with a circumferential or part-circumferential notch in which a holding pin connected to lever 26 can engage. In another form, the lever 26 may be formed as a leaf with an oval opening, engageable and disengageable from the post 7, directly, or in a circumferential, or part-circumferential groove formed therein.

The various trays may have different height, so that the depth of the tray compartment can be suitably selected. Thus, various types of tools and supplies, such as flat tools as well as bulky tools can be carried in the various trays. The material for the various trays is preferably a tough plastic, thus providing for the sturdy carrier, not subject to rusting, which is additionally lightweight, easy to make, and of pleasing appearance. The handles can be locked against each other by means of a padlock, or another locking arrangement, for example associated with the end of one of the cross pins 30, after engagement in the respective eye 31 (FIG. 4).

The same locking arrangement and the same assembly can be provided for many types of carriers, of different carrying capability, regardless of the number of intermediate trays or levels which are needed. The only change necessary is the length of the portion of the support post 7 beneath the knee 10. The foldable guide posts, in combination with the locking eye, or any other locking arrangement can thereby result in a carrier which is easily closed when collapsed, without interfering with ready portability thereof, particularly since the superimposed, folded-over posts provide a good, easily grasped handle.

Various changes and modifications may be made within the scope of the inventive concept.

I claim:

1. Multi-compartment, mutli-level stacking carrier comprising a plurality of trays (2, 3, 4) of substantially similar outline stacked above each other;

elongated tension means (9) engaging the trays and secured to the top tray and holding the trays in relative spaced position when the carrier is erected;

at least two elongated tubular guide posts (7) located at opposite sides of the carrier and extending perpendicularly with respect to the trays, the guide posts, each including a folding knee joint (10) to permit articulation thereof in one direction and folding of the guide posts flat over the top-most tray (4) of the stacked trays (2, 3, 4), the knee joint (10) on one of the posts being located at the height above the height of the trays, when the trays are stacked tightly above each other, to permit folding-over of the portion of the post above the respective joint to extend transversely across the topmost tray, the knee joint of the other post being located offset vertically with respect to the knee joint of said one post by the thickness of the post to permit folding of the posts above each other and form a carrying handle for the carrier;

and respective locks (8) secured to the topmost tray (4) engaging respective posts (7) each said locks including guide means (24) secured to at least the topmost tray and engaging the respective posts;

and movable locking means (26), located on the topmost tray (4) and operable to engage the posts.

2. Carrier according to claim 1, wherein the movable locking means comprises a movable locking lever (26) and a spring engaging the locking lever, the locking lever being located on at the topmost tray and operable with respect to the respective post to engage the post on the pressure and, upon weight being placed on the tray, to force the post towards that guide means, the locking lever being releaseable from the post by manual operation thereof counter the force of the spring.

3. Carrier according to claim 2, wherein the locking lever (26) is formed with a notch (28) and the post (7) is formed with a cross pin (30), the lever being movable in a plane transverse to the axis of the cross pin, the notch in the locking lever being engageable with the cross pin and being formed to force the cross pin, and hence the post, in the direction towards the guide means (24) upon movement of the lever in locking direction, to lock the tray against the post, and the post against the guide means and thus lock the tray and the post securely together and to hold the tray at the level of the cross pin.

4. Carrier according to claim 2, further comprising manually engageable press means (29) operatively connected to the locking lever (26) to move the locking lever counter the spring force and counter the engagement force, and thus release the locking lever, and hence the top tray (4) from locked position on the post.

5. Carrier according to claim 4, wherein the spring (28) is located beneath the press bar (29) and fits within a recess formed in the top tray (4).

6. Carrier according to claim 2, wherein the guide means comprise prismatic elements (24) located on the tray at the outside of the post — with respect to the center of the tray — and the locking lever (26) is pivotable about an axis transverse to the axis of the post (7) when erected, and is formed with camming means (27) engaging the post and tending to move the post in an outward direction, and into engagement with said prismatic guide means (24) when the lever (26) is rocked about its pivot axis.

7. Carrier according to claim 1, wherein the depth of at least two of the trays is different, and the top tray (4) carries two locks, one at each end adjacent the respective post.

8. Carrier according to claim 1, wherein the topmost tray forms a cover for the carrier.

9. Carrier according to claim 1, wherein the topmost tray includes means defining holding eyes (31) located to be engageable with the posts (7), when the posts are folded over by being articulated about the respective joints, (10) to hold the posts in folded position and form a carrying handle integrally secured to the carrier.

10. Carrier according to claim 1, wherein the trays are made of plastic.

11. Carrier according to claim 1, wherein the trays are compartmented trays, the size of the compartments within at least one of the trays being adjustable.

* * * * *